United States Patent [19]

McCoy

[11] 3,951,832

[45] Apr. 20, 1976

[54] STABILIZED POLYSILOXANE-POLYGLYCOL FOAM INHIBITORS FOR MINERAL OILS

[75] Inventor: Frederic C. McCoy, Beacon, N.Y.

[73] Assignee: Texaco Inc., New York, N.Y.

[22] Filed: Nov. 13, 1974

[21] Appl. No.: 523,295

[52] U.S. Cl. ..... 252/49.6; 252/358; 252/400 R; 260/824 R

[51] Int. Cl.[2] ..... C10M 1/10

[58] Field of Search ..... 252/49.6, 358; 260/824 R

[56] References Cited

UNITED STATES PATENTS

| | | | |
|---|---|---|---|
| 2,717,242 | 9/1955 | Foehr | 252/49.6 |
| 2,834,748 | 5/1958 | Bailey et al. | 260/825 X |
| 2,917,480 | 12/1959 | Bailey et al. | 252/49.6 X |
| 3,383,315 | 5/1968 | Gothel et al. | 252/49.6 |
| 3,457,173 | 7/1969 | Pater | 252/49.6 X |
| 3,480,583 | 11/1969 | Bailey et al. | 252/49.6 X |
| 3,600,418 | 8/1971 | Bailey et al. | 252/49.6 X |
| 3,629,310 | 12/1971 | Bailey et al. | 252/49.6 X |
| 3,814,691 | 6/1974 | Csejka et al. | 252/49.6 X |

*Primary Examiner*—Delbert E. Gantz
*Assistant Examiner*—Andrew H. Metz
*Attorney, Agent, or Firm*—T. H. Whaley; C. G. Ries; Bernard Marlowe

[57] ABSTRACT

This invention concerns the preparation of stabilized polydimethylsiloxane-polyalkylene glycol block copolymers complexed with alkyl phenols. The resultant complexes have improved storage stability and are soluble in mineral oils. Solutions of the complexes in mineral oil exhibit better foam-inhibition than do oil dispersions of the uncomplexed polymers. In addition the oil-soluble complexes have improved extreme pressure properties.

9 Claims, No Drawings

STABILIZED POLYSILOXANE-POLYGLYCOL FOAM INHIBITORS FOR MINERAL OILS

SUMMARY OF THE INVENTION

This invention relates to novel, homogeneous mineral oil-soluble polydimethylsiloxane-polyalkylene glycol copolymers having improved storage stability and which are useful as anti-foaming agents in mineral oils.

More particularly, this invention concerns alkyl phenol complexes of the above copolymers which exhibit substantially better anti-foam properties in mineral oils than do the original (uncomplexed) polydimethylsiloxane-polyalkylene glycol copolymers.

BACKGROUND OF THE INVENTION

Foaming presents a serious problem in many industrial lubrication applications especially in various types of engines operated at high speed and which are lubricated with mineral oil. For example, foaming is particularly a problem in conventional internal combustion engines, turbines, gear sets and for various aircraft engines operated at high speed. Without foam inhibitors severe churning and mixing of the oil with air allows foam to form and under continuous use the foam, a mixture of air and oil may overflow from the lubrication system leading to eventual failure of the machine or parts causing expensive breakdowns or costly maintenance problems.

Among the foam inhibitors known to be effective in mineral oils are organo-silicone, polymeric compositions referred to as silicone-polyglycol copolymers, silicone polyethers or silicone polyether polymers, among other names. A group of these compositions are disclosed in U.S. Pat. No. 2,834,748 and are designated as siloxane-oxyalkylene block copolymers. Unfortunately, these copolymers, while effective in actual operation, have certain deficiencies which complicate their formulation and storage.

For instance, since these polymers are not soluble in mineral oils to any appreciable extent, they must be added to oil in the form of solutions in low-boiling solvents, such as benzene or its homologues. Further, because of their insolubility in oil, they form dispersions which tend to stratify in storage over considerable periods of time, thereby degrading the anti-foam effect. In addition, some of the desired polymers are sensitive to moisture and become non-homogeneous in contact with air over relatively long periods of storage.

Thus, the objects of this invention are to convert siloxane-oxyalkylene block copolymers to an oil-soluble form in order to improve their utility as foam inhibitors, and at the same time to improve their resistance to degradation by moisture.

Recently it has been found that the settling out or stratification problems can be overcome by forming a complex (or stable admixture) of the above copolymers or similar types of siloxane-type copolymers with certain alkylated phenols. Not only do the complexes formed stabilize the copolymers but even more surprising the alkyl-phenol-complexed copolymers usually show substantially enhanced defoaming properties in mineral oil-based lubricants compared to the untreated (non-complexed) copolymers. The enhancement of anti-foaming in mineral oil systems by forming the alkyl phenol complex is quite unexpected in that:

1. The alkylated phenols used to complex the copolymers used along are not anti-foamants in mineral oil.

2. The untreated "siloxane" copolymers, as described in U.S. Pat. No. 2,834,748, include at least one polyoxyalkylene chain preferably three polyoxyalkylene chains in the molecule. Yet polyglycols alone or polyglycols admixed with alkylphenols to form complexes are not anti-foamants in a mineral oil system, within the concentration range in which the solubilized copolymers are effective.

3. The admixing of said copolymer with alkylated phenol, presumably to form a stabilizing complex (or stable admixture) takes place at room temperatures and atmospheric pressures using standard equipment and routine laboratory techniques. In fact, no special order of addition of the alkylated phenol to substrate is required.

A convenient method for determining the ratio of alkylphenol to silicone substrate required to achieve solubility in a given mineral oil is to add the alkylphenol slowly with vigorous agitation to a mixture of about two parts mineral oil to one part silicone substrate. When a clear, bright solution is observed, the minimum ratio of silicone to alkylphenol is now known. This concentrate can be added to the same or different mineral oils to achieve whatever concentration of polymer is desired. Alternatively once the ratio of alkylphenol to silicone necessary to achieve oil solubility has been determined, a complex containing only silicone and alkylphenol can be prepared for subsequent use as an anti-foamant or for other uses, as desired.

In the usual practice, each part by weight of polymeric silicone substrate to be stabilized having the following characteristics:

Average molecular weight - 1000 to 5000
Silicon (% by weight) - 4 to 30
Dimethyl siloxane (% by weight) - 10 to 95
Identity of Polyglycol - Ethylene glycol, or ethylene-glycol-propylene glycol copolymers
Polyglycol (% by weight) - 90 to 5 is admixed with from 1–20 parts of petroleum (mineral) oil having a viscosity at 100°F of about 50 centistokes and at least one part by weight of alkylated phenol is added with stirring, wherein said alkylating group or groups containing a total of from 4 to 30 carbon atoms, until a visually clear, homogeneous and stabilized complex of polymeric substrate and alkylated phenol in mineral oil is produced.

In the favored practice each part by weight of a polymeric silicone-polyglycol substrate to be stabilized for storage and having the following characteristics:

Average molecular weight - 1500 to 3000
Silicon (% by weight) - 10 to 30
Dimethyl siloxane (% by weight) - 20 to 50
Identity of Polyglycol - 50% polyethylene 50% polypropylene
Polyglycol (% by weight) - 50 to 80 is admixed with from 2–10 parts petroleum (mineral) oil and at least 2 to 8 parts by weight of alkylated phenol, wherein said alkylating group or groups contain a total of from 4 to 30 carbon atoms until a visually clear, homogeneous and stabilized complex of polymeric substrate and alkylated phenol in mineral oil is produced.

In order to provide the scope of the inventive concept the following additional disclosure is submitted.

A. Alkylated phenol-type compound

This is the generic term used to designate the class of complexing agents employed to improve the storage stability of the mineral oil-silicone/polyglycol copolymer compositions and, in most instances, the foam-inhibiting properties of the copolymers when dispersed in mineral oil. While no specific mechanism is relied on for patentability, nor postulated to explain how or why the copolymers and alkylated phenols function better together than when employed singly, it is believed that a complex is formed between the phenolic hydrogen and the polyglycol oxygen which potentiates the foam inhibition of the copolymers by enabling them to be more uniformly dispersed throughout the oil. The same mechanism is thought to be responsible for their oil solubility and improved storage stability.

Illustrative alkylated phenols are chosen from either or both mono- and dinuclear aromatics that contain one hydroxyl group and an alkylating group or groups containing a total of between 4 and 30 carbon atoms, arranged in either branched chains or straight chains. The alkylated phenol-type compound can be in the form of a relatively pure discrete single compound or in the form of blends or mixtures of one or more alkylated phenols.

Illustrative preferred complexing agents are the butyl phenols, the pentyl phenols, the hexyl phenols, the heptyl phenols, the octyl phenols, the nonyl phenols, the decyl phenols, the undecyl phenols and the dodecyl and tridecyl phenols. Especially preferred are the alkylated phenols in which the alkyl groups contain from 9 to 16 carbon atoms and are branched rather than straight chain.

B. Polysiloxane-Polyglycol Polymers

This is the generic nomenclature used throughout this application for the substrate whose stability is to be improved. These copolymeric substrates which lend themselves to treatment for improved stability have been empirically derived polymers selected from the group consisting of Siloxane-Oxyalkylene Block copolymers of the general formula disclosed in U.S. Pat. No. 2,834,748, Col. 2 as:

$$(R)'(SiO_3)_x(R_2SiO)_y[C_nH_{2n}O)_zR'']_a[R''']_{3x-a}$$

where $x$ is an integer and represents the number of trifunctional silicon atoms bonded to a single monovalent or multivalent hydrocarbon radical R', $a$ is an integer and represents the number of polyoxyalkylene chains in the block copolymer; $y$ is an integer having a value of at least 3 and denotes the number of difunctional siloxane units, $n$ is an integer from 2 to 4 denoting the number of carbon atoms in the oxyalkylene group and $z$ is an integer having a value of at least 5 and denotes the number and length of the oxyalkylene chain.

The above polymers can be formed by reacting a polyalkoxy-polysiloxane having at least three (3) alkoxy groups attached to a polysiloxane chain with a monohydroxyl polyoxyalkylene mono-ether by an exchange reaction wherein at least part of the alkoxy groups attached to the polysiloxane are replaced by polyoxyalkylene mono-ether radicals and the alkoxy groups removed as the corresponding alkanols.

While the block copolymers of this invention usually conform to the preceding chemical composition and method of manufacture, no need is seen to be limited thereto since any copolymer consisting of a silicone moiety and a polyalkylene glycol moiety can be stabilized by the disclosed process.

C. Condition required for the Treatment of the Siloxane-Polyalkylene Glycol Copolymers with Alkylated Phenols to improve their Stability Of the conditions required for the stabilizing of the polydimethylsiloxane-polyalkylene glycol copolymers, (temperature, time of mixing, order of addition, ratio of components), none is critical to success except the latter. As previously indicated, the alkylated phenol should be employed in weight excess, preferably from 1 to 20 parts by weight of said phenol to each part by weight of copolymer. The ratio will vary depending on the particular polymer and alkylated phenol (alkyl phenol) involved.

The usual procedure where it is desired to make an oil concentrate, is to add the copolymer to the mineral oil with continuous stirring and then to add the alkylated phenol slowly, usually between 20°C and 50°C, until a homogeneous complex that is clear to the eye is attained. The term complex as used throughout this disclosure refers to that of a group of obviously related units of which the degree and nature of the relationship is imperfectly known. Additional alkylphenol beyond that necessary to achieve clarity is not harmful but is usually unnecessary and therefore to be avoided.

If it is desired to eliminate the mineral oil from the complex, and provided the proper ratio of polymer to alkylphenol is already known, the two components can be simply mixed by conventional stirring at 30–50°C.

The time required for preparation of the complex cannot be set forth precisely, since the copolymer and alkylated phenol employed, the type of agitation used and temperature at which complex formation is undertaken all vary from instance to instance. However, in most instances the time required will be between a few minutes up to less than one half hour.

D. Hydrocarbon Oils

As used throughout this application the terms "mineral oil", "hydrocarbon oils" are synonymous with "petroleum oils". Mineral oils which are subject to foam inhibition when mixed with the inventive complexes are paraffinic oils, naphthenic and asphaltic oils having kinematic viscosities at 100°F from about 10 centistokes to about 5000 centistokes.

E. Characteristics of the Copolymer Substrates to be Complexed.

| | Operable Range | Preferred Range |
|---|---|---|
| Molecular Weight | 1000 – 5000 | 1500 – 3000 |
| % By Weight of Silicon | 4 – 30 | 10 – 25 |
| % By Weight Dimethylsiloxane | 10 – 95 | 20 – 50 |
| % By Weight of Polyglycol | 90 – 5 | 50 – 80 |

Type of Polyglycols — polyethylene glycol and ethylene-glycol-propylene glycol copolymers.

Table I shows characterizing tests on the polymers employed in the subsequent examples. It will be noted that all are insoluble in mineral oil, as evidenced by the fact that a 0.1% by weight blend of polymer in a paraffinic oil is cloudy at 25°C.

TABLE I

| | CHARACTERIZATION OF COPOLYMERS | | | | | | | |
|---|---|---|---|---|---|---|---|---|
| COPOLYMER IDENT. | A | B | C | D | E | F | G | H |
| OIL SOLUBILITY[6] | Insol. | Insol. | Insol. | Insol. | Insol. | Insol. | Insol. | Insol. |

TABLE I-continued

| COPOLYMER IDENT. | CHARACTERIZATION OF COPOLYMERS A | B | C | D | E | F | G | H |
|---|---|---|---|---|---|---|---|---|
| MOLECULAR WEIGHT | 2360 | 3050 | 2730 | 2380 | 1440 | 1860 | 1340 | 1850 |
| ANALYSIS (WT.) | | | | | | | | |
| SILICON, % | 6.8 | 7.4 | 4.7 | 13.4 | 9.5 | 9.3 | 22.5 | 26.6 |
| CARBON, % | 53.0 | 53.4 | 54.9 | 49.8 | 46.5 | 30.6 | 43.4 | 36.9 |
| HYDROGEN, % | 9.5 | 9.7 | 9.2 | 9.3 | 9.1 | 8.6 | 8.9 | 6.2 |
| OXYGEN (BY DIFFERENCE) | 30.7 | 29.5 | 31.2 | 27.5 | 34.9 | 51.5 | 25.2 | 30.3 |
| APPROXIMATE COMPOSITION[1] | | | | | | | | |
| DIMETHYL SILOXANE POLYMERS | 20 | 20 | 12 | 35 | 30[2] | 30[3] | 70 | 90 |
| POLYGLYCOL POLYMERS[5] | 80 | 80 | 88 | 65 | 70 | 70 | 30[4] | 10 |

[1]BASIS ELEMENTAL ANALYSIS
[2]LOWER M.W. SILICONE MOIETY
[3]HIGHER M.W. SILICONE MOIETY
[4]POLYPROPYLENE GLYCOL
[5]ALL POLYETHYLENE OR POLYETHYLENE/POLYPROPYLENE EXCEPT COPOLYMER G.
[6]AT 0.1% BY WT., WILL NOT GIVE A CLEAR BLEND IN PARAFFINIC MINERAL OIL AT 25°C.

In order to disclose this invention in the greatest possible detail, the following illustrative examples are set forth. Unless specified otherwise, all percentages and parts are by weight rather than volume, and all temperatures are in degrees centigrade.

The following is a more detailed characterization of the base oils referred to in the subsequent examples:

| DESIGNATION BASE OIL TYPE | BASE OIL A Highly Solvent Refined Paraffin Base Neutral oil | BASE OIL B Solvent Refined Paraffin Base Residual Oil | BASE OIL C Moderately Solvent refined Neutral Oil |
|---|---|---|---|
| Viscosity, Kinematic at 100°F., cs. | 69.6 | 717.1 | 20.8 |
| Viscosity Index | 103 | 82 | 63 |
| Pour Point, °F. | +5 | 0 | +15 |
| Gravity, API | 29.2 | 24.2 | 28.5 |

EXAMPLE 1

PREPARATION OF A TYPICAL POLYMERIC SILOXANE ALKYLATED PHENOL COMPLEX a. Using a conventional heated mixing vessel containing a variable speed propeller stirrer, 1 part by weight of polydimethyl siloxane-polyalkylene glycol block copolymer substrate prepared as in U.S. Pat. No. 2,834,748 and having the characteristics shown in Table I under "Polymer A" is mixed with 95 parts by weight of Base Oil A at 25°C with continuous propeller stirring at about 500 rpm. Nonylphenol is added slowly until the blend becomes clear. A total of 4 parts nonylphenol is required to form the clear complex. The time required is about 5 minutes. The complex is now available for use as an anti-foam agent.

b. The foam-inhibition of the resultant oil-soluble complex was determined in ASTM FOAM TEST (D-892) in Blend 5 of Table 3.

EXAMPLES 2-12

PREPARATION OF OTHER COMPLEXES

Using the copolymer substrates shown in Table II, other complexes were prepared, following the procedure of Example 1, for foam inhibition tests, as outline in Table III.

The data of Table III reveal the following points:

a. All of the copolymers show foam-inhibiting porperties, except Polymer G. The failure of this copolymer to show effectiveness may be due to the fact that in this case the polyglycol moiety is polypropylene glycol, whereas in all of the other examples, the polyglycol moiety is either polyethylene or a mixture of polyethylene and polypropylene. (Blend 30).

b. Complexation of the copolymers with alkylphenol usually improves foam inhibition. (Blends 5 and 6; 13 and 14, 11 and 12, for example).

c. Alkylphenols are not foam inhibitors by themselves (Blends 4, 10, 17).

d. Polyethylene glycol complexed with alkylphenol is not a foam inhibitor (Blend 15).

TABLE II

| EXAMPLE | PREPARATION OF POLYMER — ALKYLPHENOL COMPOSITIONS MINERAL OIL IDENT. | PARTS BY WT. | POLYMER IDENT. | PARTS BY WT. | ALKYLPHENOL IDENT. | PARTS BY WT. | BLENDS IN WHICH USED |
|---|---|---|---|---|---|---|---|
| 1 | A | 95 | A | 1 | NONYL | 4 | 5 |
| 2 | A | 95 | B | 1 | NONYL | 4 | 7 |
| 3 | A | 95 | B | 1 | DODECYL | 4 | 9 |
| 4 | A | 95 | C | 1 | NONYL | 4 | 11 |
| 5 | A | 95 | D | 1 | NONYL | 4 | 13, 19, 21, 22 |
| 6 | A | 95 | I | 1 | NONYL | 5 | 15 |
| 7 | A | 68.55 | B | 1.85 | DIISOPROPYL | 29.60 | 16 |
| 8 | A | 95 | E | 1 | NONYL | 6 | 24, 26 |
| 9 | A | 95 | F | 1 | NONYL | 7 | 28 |
| 10 | NONE | | G | 1 | NONYL | 2 | 30 |
| 11 | A | 93 | H | 1 | NONYL | 6 | 32 |
| 12 | A | 49.2 | A | 15.4 | NONYL | 35.4 | — |

TABLE II-continued

| PREPARATION OF POLYMER — ALKYLPHENOL COMPOSITIONS | | | | | | | |
|---|---|---|---|---|---|---|---|
| | MINERAL OIL | | POLYMER | | ALKYLPHENOL | | BLENDS IN WHICH USED |
| EXAMPLE | IDENT. | PARTS BY WT. | IDENT. | PARTS BY WT. | IDENT. | PARTS BY WT. | |
| 14 | A | 84 | F | 5 | NONYL | 16 | — |

GENERAL PROCEDURE: POLYMER ADDED TO MINERAL OIL AT 25°C. WITH STIRRING.
ALKYLPHENOL ADDED WITH CONTINUED STIRRING UNTIL BLEND BECOMES CLEAR.

TABLE III

| BLEND | BASE OIL | POLYMER IDENT. | POLYMER AMT.(WT.) | FOAM TEST DATA ALKYLPHENOL IDENT. | ALKYLPHENOL AMT.(WT.) | ASTM FOAM TEST, SEQUENCE I (D-892) FOAM AT 5-MIN. — ML | FOAM COLLAPSE TIME — SEC. |
|---|---|---|---|---|---|---|---|
| 1 | A | NONE | | NONE | | 300 | 600+ |
| 2 | 50%A-50-%B | do. | | do. | | 310 | 40 |
| 3 | C | do. | | do. | | 220 | 95 |
| 4 | A | do. | | NONYL | 400 PPM | 620 | 600+ |
| 5 | A | A | 100 PPM | NONYL | 400 PPM | 0 | 0 |
| 6 | A | A | 100 PPM | NONE[1] | | 560 | 600+ |
| 7 | A | B | 100 PPM | NONYL | 400 PPM | 0 | 0 |
| 8 | A | B | 100 PPM | NONE[2] | | 10 | 4 |
| 9 | A | B | 100 PPM | DODECYL | 400 PPM | 0 | 0 |
| 10 | A | NONE | | DODECYL | 400 PPM | 570 | 567 |
| 11 | A | C | 100 PPM | NONYL | 440 PPM | 0 | 0 |
| 12 | A | C | 100 PPM | NONE[2] | | 400 | 572 |
| 13 | A | D | 100 PPM | NONYL | 560 PPM | 0 | 0 |
| 14 | A | D | 100 PPM | NONE[2] | | 100 | 73 |
| 15 | A | I[3] | 100 PPM | NONYL | 500 PPM | 500 | 600+ |
| 16 | A | B | 100 PPM | DIISO-PROPYL | 1590 PPM | 0 | 0 |
| 17 | A | NONE | | DIISO- | 1600 PPM | 560 | 600+ |
| 18 | C | B | 100 PPM | NONYL | 400 PPM | 10 | 0 |
| 19 | 50%A-50-%B | D | 100 PPM | NONYL | 560 PPM | 0 | 0 |
| 20 | 50%A-50-%B | D | 100 PPM | NONE[2] | | 0 | 0 |
| 21 | A | D | 60 PPM | NONYL | 340 PPM | 0 | 0 |
| 22 | A | D | 30 PPM | NONYL | 170 PPM | 0 | 0 |
| 125 | A | D | 30 | PPM | NONE[2] | | 140 |
| 24 | A | E | 10 PPM | NONYL | 60 PPM | 0 | 0 |
| 25 | A | E | 10 PPM | NONE[2] | 10 | 27 | |
| 26 | A | E | 5 PPM | NONYL | 30 PPM | 10 | 14 |
| 27 | A | E | 5 PPM | NONE[2] | | 50 | 59 |
| 28 | A | F | 10 PPM | NONYL | 60 PPM | 0 | 0 |
| 29 | A | F | 10 PPM | NONE[2] | | 0 | 0 |
| 30 | A | G | 100 PPM | NONYL | 200 PPM | 660 | 600+ |
| 31 | A | G | 100 PPM | NONE[1] | | 660 | 600+ |
| 32 | A | H | 100 PPM | NONYL | 600 PPM | 10 | 36 |
| 33 | A | H | 100 PPM | NONE[2] | | 350 | 434 |

[1]Copolymer dispersed in oil with Waring blender
[3]Polymer I is a polyethylene glycol of approx. 1500 m.w.
[2]Copolymer dissolved in benzene and dispersed in oil with Waring blender As the several examples and the preceding specification indicate, the novel inventive concept offers advantages heretofore not available in the art of foam suppression in mineral oil-based compositions using siloxane copolymers as the anti-foaming agent.

For instance, as outlined above, in most cases the foam-inhibition of the complexes is superior to that of the uncomplexed copolymers, added as solutions in benzene. In addition, in all formulations the resultant complexes show significantly increased solubility in mineral oils over the uncomplexed silicone-polyglycol copolymers. Insofar as is known the resultant compexes of alkylated phenols and said copolymers are not known in the prior art.

An additional advantage is that the complexes formed can be formulated using standard mixing and blending equipment and known techniques under ambient parameters of temperatures and pressures.

Still further advantages are illustrated by the following examples.

EXAMPLE 13

A loosely stoppered container of copolymer A is allowed to stand at room temperature for 4½ years. During this period, the original clear liquid became a cloudy, moderately stiff gel, probably because of hydrolysis by atmospheric moisture.

The complex of Example 12, after standing 4½ years in a loosely stoppered container, also at room temperature was still clear and bright.

EXAMPLE 14

When the composition shown in Table II under Example 14 was tested in the SAE EP Test (500 PPM), a value of 334 lbs. was obtained. This oil contained 5% Polymer F and 16% nonylphenol. When the same base oil, containing 16% nonylphenol but no polymer was tested, a value of 112 lbs. was obtained. Thus, polymer F is shown to impart extreme pressure properties to Base Oil A.

These data were obtained on the SAE Lubrication Test Machine as described on pages 216-218 of "A Catalog of Friction and Wear Devices" compiled by the American Society of Lubrication Engineers Lubrication Fundamentals Committee.

Finally, a perusal of the preceding specification clearly suggests that the inventive concepts disclosed are relatively flexible in that numerous changes, variations, modifications and the like can be made in choice of siloxane substrates, complexing agents, proportions, temperatures, etc. without departing from the inventive concept. The metes and bounds of this invention can best be determined by an examination of the claims which follow taken in conjunction with the specification.

What is claimed is:

1. A process for preparing storage stable, clear mineral oil solutions of polysiloxane-polyglycol polymeric substrates, said substrates normally being insoluble in mineral oil, said polymeric substrates having the following range of characteristics:

Average molecular weight range - about 1000 to 5000,
Silicon (% by weight) - about 4 to 30,
Carbon (% by weight) - about 25 to 60,
Hydrogen (% by weight) - about 5 to 10,
Dimethylsiloxane (% by weight) - about 10 to 95,
Polyglycol component (% by weight) - 90 to 5, said polyglycol being selected from the group consisting of polyethylene glycol and ethylene glycol-propylene glycol copolymers, said process consisting essentially of mixing each part by weight of said substrates to be stabilized, with from about 1 to 20 parts by weight of mineral oil having the following characteristics:

Viscosity, Kinematic 100°F, cs. - 10 to 5000
Viscosity Index - 50 to 120
Pour Point, °F - 0 to 25
Gravity, API - 20 to 30, and from at least 1 part by weight of alkylated phenol, said alkyl group or groups of the alkylated phenol containing from 4 to 30 carbon atoms to form an admixture and maintaining the admixture between about 20°C and 50°C until clear, storage-stable mineral oil solutions of polymeric substrates are produced.

2. The process of claim 1 wherein the mineral oil is a solvent refined paraffin-base neutral oil.

3. The process of claim 1 wherein the mineral oil is a solvent refined paraffin-base residual oil.

4. The process of claim 1 wherein the mineral oil is a solvent refined neutral oil.

5. The storage-stabilized, foam-inhibiting mineral oil solution of normally mineral oil-insoluble polysiloxane-polyglycol block copolymer substrates consisting essentially of the following components in the proportions shown below:

a. for each part by weight of polydimethyl siloxane glycol copolymer substrates having the following characteristics:

Average molecular weight range - about 1000 to 5000,
Silicon (% by weight) - about 4 to 30,
Carbon (% by weight) - about 25 to 60,
Hydrogen (% by weight) - about 5 to 10,
Dimethylsiloxane (% by weight) - about 10 to 95,
Polyglycol component (% by weight) - 90 to 5, said polyglycol being selected from the group consisting of polyethylene glycol and ethylene glycol-propylene glycol copolymers, b. from about 1 to 20 parts by weight of mineral oil having the following characteristics:

Viscosity, Kinematic 100°F, cs. - 10 to 5000,
Viscosity Index - 50 to 120,
Pour Point, °F - 0 to 25,
Gravity, API - 20 to 30, and c. from about 1 to 20 parts by weight of alkylphenol, said alkyl group or groups of alkylphenol containing from 4 to 30 carbon atoms.

6. A process for preparing storage stable, clear mineral oil-soluble complexes of polysiloxane-polyglycol block polymeric substrates, said polymeric substrates normally being insoluble in mineral oil, said polymeric substrates having the following range of characteristics:

Average molecular weight range - about 1000 to 5000,
Silicon (% by weight) - about 4 to 30,
Carbon (% by weight) - about 25 to 60,
Hydrogen (% by weight) - about 5 to 10,
Dimethylsiloxane (% by weight) - about 10 to 95,
Polyglycol component (% by weight) - about 90 to 5, said polyglycol component being selected from the group consisting of polyethylene glycol and ethylene glycol-propylene glycol copolymers, said process consisting essentially of mixing each part by weight of said polymeric substrates to be stabilized, with from at least 1 part by weight of alkylated phenol, said alkyl group or groups of the alkylated phenol containing from 4 to 30 carbon atoms to form an admixture and maintaining the admixture between about 30°C and 50°C until clear, storage-stable mineral oil-soluble complexes of polymeric substrates are produced.

7. The storage-stabilized, foam-inhibiting, mineral oil-soluble complexes of polysiloxane-polyglycol block copolymer substrates and alkylated phenols consisting essentially of the following components in the proportions shown below:

a. for each part by weight of polydimethyl siloxane glycol copolymer substrates having the following characteristics:

Average molecular weight range - about 1000 to 5000,
Silicon (% by weight) - about 4 to 30,
Carbon (% by weight) - about 25 to 60,
Hydrogen (% by weight) - about 5 to 10,
Dimethylsiloxane (% by weight) - about 10 to 95,
Polyglycol component (% by weight) - 90 to 5, said polyglycol being selected from the group consisting of polyethylene glycol and ethylene glycol-propylene glycol copolymers, and b. from about 1 to 20 parts by weight of alkylphenol, said alkyl group or groups of alkylphenol containing from 4 to 30 carbon atoms.

8. The storage-stabilized, foam-inhibiting mineral-oil solution of claim 5 wherein the mineral oil solution of alkylated phenols and polymeric substrates is further diluted with mineral oil until the concentration of said polymeric substrates based on the final mineral oil content is between 1 and 1000 ppm.

9. The storage-stabilized, foam-inhibiting mineral oil soluble complexes of claim 7 wherein the complexes of alkylated phenols and polymeric substrates are diluted with mineral oil until the concentration of said polymeric substrates based upon the final mineral oil content is between 1 and 1000 ppm.

* * * * *